US008093992B2

(12) United States Patent
Jancic et al.

(10) Patent No.: US 8,093,992 B2
(45) Date of Patent: Jan. 10, 2012

(54) WIRELESS CONTROLLED DEVICES FOR A WEAPON AND WIRELESS CONTROL THEREOF

(75) Inventors: Dale Allen Jancic, Bedford, NH (US); Paul Joseph Deyeso, Londonderry, NH (US)

(73) Assignee: L-3 Communications Insight Technology Incorporated, New York, NY (US)

( * ) Notice: Subject to any disclaimer, the term of this patent is extended or adjusted under 35 U.S.C. 154(b) by 591 days.

(21) Appl. No.: 12/257,188

(22) Filed: Oct. 23, 2008

(65) Prior Publication Data

US 2009/0111454 A1 Apr. 30, 2009

Related U.S. Application Data

(63) Continuation of application No. 10/819,429, filed on Apr. 7, 2004, now abandoned.

(60) Provisional application No. 60/460,935, filed on Apr. 7, 2003.

(51) Int. Cl.

| | |
|---|---|
| ***G05B 11/01*** | (2006.01) |
| ***G08C 19/16*** | (2006.01) |
| ***G08C 19/12*** | (2006.01) |

(52) U.S. Cl. ..... 340/12.5; 340/12.52; 340/13.24; 340/13.25; 42/111; 42/117; 455/88

(58) Field of Classification Search ..... 340/12.5, 340/12.52, 13.24, 13.25; 42/111, 117, 123; 455/88; 380/255

See application file for complete search history.

(56) References Cited

U.S. PATENT DOCUMENTS

| | | | | |
|---|---|---|---|---|
| 3,757,303 | A | | 9/1973 | Blass |
| 3,939,679 | A | | 2/1976 | Barker et al. |
| 4,666,103 | A | * | 5/1987 | Allen ..... 244/3.11 |
| 4,884,137 | A | * | 11/1989 | Hanson et al. ..... 348/158 |
| 5,359,779 | A | | 11/1994 | Polk et al. |
| 5,448,847 | A | | 9/1995 | Teetzel et al. |
| 5,522,167 | A | | 6/1996 | Teetzel et al. |
| 5,555,662 | A | | 9/1996 | Teetzel et al. |
| 5,570,528 | A | | 11/1996 | Teetzel et al. |
| 5,583,491 | A | | 12/1996 | Kim |
| 5,584,137 | A | | 12/1996 | Teetzel et al. |
| 5,590,486 | A | | 1/1997 | Moore |
| 5,669,174 | A | | 9/1997 | Teetzel et al. |
| 5,675,112 | A | | 10/1997 | Giry et al. |
| 5,685,105 | A | | 11/1997 | Teetzel |
| 5,740,037 | A | | 4/1998 | McCann et al. |
| 5,787,628 | A | | 8/1998 | Teetzel et al. |

(Continued)

OTHER PUBLICATIONS

Microchip—"Keeloq Evaluation Kit UU User's Guide," Microchip Technology Incorporated, Chandler, AZ, pp. 1-46, Jun. 2001.

(Continued)

*Primary Examiner* — Nam V Nguyen
(74) *Attorney, Agent, or Firm* — Grossman, Tucker, Perreault & Pfleger, PLLC

(57) ABSTRACT

A system and method related to weapon mounted auxiliary devices that can be operated by wireless remote control, and a remote controller by which an operator can operate the auxiliary devices remotely by wireless control. This includes all means of remote control of the auxiliary devices to include but not be limited to radio frequency (RF), infrared (IR) energy, all other wavelengths of the electromagnetic spectrum, and acoustic, pressure, or sound waves. Control of the auxiliary devices can range from simple activation to wireless control of all auxiliary device controls and adjustments. This can also include a single remote control device that can operate one or more weapon mounted auxiliary devices.

20 Claims, 10 Drawing Sheets

U.S. PATENT DOCUMENTS

| | | | | |
|---|---|---|---|---|
| 5,822,905 | A | 10/1998 | Teetzel et al. | |
| 5,864,481 | A | 1/1999 | Gross et al. | |
| 6,008,735 | A | 12/1999 | Chiloyan et al. | |
| 6,046,680 | A | 4/2000 | Soenen et al. | |
| 6,175,312 | B1 | 1/2001 | Bruwer et al. | |
| 6,243,022 | B1 | 6/2001 | Furukawa | |
| 6,259,362 | B1 | 7/2001 | Lin | |
| 6,297,746 | B1 | 10/2001 | Nakazawa et al. | |
| 6,412,207 | B1 | 7/2002 | Crye et al. | |
| 6,519,083 | B2 | 2/2003 | Heinrich | |
| 6,582,105 | B1 * | 6/2003 | Christensen | 362/385 |
| 6,615,531 | B1 | 9/2003 | Holmberg | |
| 6,641,277 | B2 | 11/2003 | Smith | |
| 6,791,467 | B1 | 9/2004 | Ben-Ze'ev | |
| 6,856,238 | B2 | 2/2005 | Wootton et al. | |
| 6,882,729 | B2 | 4/2005 | Arling et al. | |
| 6,886,287 | B1 | 5/2005 | Bell et al. | |
| 2002/0071513 | A1 | 6/2002 | Uckert | |
| 2002/0175828 | A1 | 11/2002 | Macey | |
| 2002/0184810 | A1 | 12/2002 | Day | |
| 2003/0034898 | A1 | 2/2003 | Shamoon et al. | |
| 2003/0129949 | A1 | 7/2003 | Selektor | |
| 2004/0200117 | A1 | 10/2004 | Gaber | |

OTHER PUBLICATIONS

Microchip—"Keeloq Code Hopping Devices," Microchip Technology Incorporated, Chandler, AZ, 2 pages, Aug. 2001.

Microchip—"Keeloq HCS1XX/2XX/3XX Encoder Family," Microchip Technology Incorporated, Chandler, AZ, 2 pages, Jun. 2001.

"Laser Breakthrough . . . Wireless Switches!" p. 17 from Sentinel Magazine, Heckler & Koch, Inc., 1993 Edition.

* cited by examiner

WIRELESS CONTROLLED DEVICES FOR A WEAPON AND WIRELESS CONTROL THEREOF

CROSS-REFERENCE TO RELATED APPLICATIONS

This application is a continuation of U.S. patent application Ser. No. 10/819,429, filed Apr. 7, 2004, now abandoned, which claims the benefit of the filing date under 35 USC §119(e) of U.S. patent application Ser. No. 60/460,935, filed on Apr. 7, 2003, the entire contents of which are hereby incorporated by reference.

TECHNICAL FIELD

This invention relates to weapon mounted auxiliary devices, and more particularly to control of such auxiliary devices.

BACKGROUND

There has been a dramatic increase in the number and types of auxiliary weapon mounted devices in military, law enforcement and consumer applications. These include passive devices such as night vision image intensifier devices, thermal imaging systems, and day optics; and active devices such as visible laser aiming devices, infrared laser aiming devices, infrared illuminators, laser range finders, and visible illuminators (e.g., weapon-mounted flashlights). All of these devices can generally be referred to as auxiliary devices. To date these auxiliary devices have been operated by a combination of switches and controls mounted on the devices themselves and by cable switches. The cable switches enable the operator to operate the weapon mounted device, while holding the weapon in a normal firing position. The cable switches arrangement is typically more convenient than the device's integral switches. Cable switches, however, can have cables that are cumbersome. If not routed properly, the cables can interfere with operation of the weapon, snag on objects or can be melted or otherwise damaged if they come into contact with hot or mechanically moving parts of the weapon. This can be exacerbated by the fact that individual weapon mounted auxiliary devices are produced for use on multiple weapon systems and are normally supplied with just a single remote cable switch with a fixed cable length. As a result, if the length of the cable is appropriate for a large weapon it is usually so long as to require unique routing in order not to have excessive slack and become a snag hazard when mounted on a smaller weapon. If the cable length is suitable for use on a small weapon, it is normally too short for use on a large weapon necessitating the operator to obtain a new cable switch. Further complicating the situation is that different operators mount their auxiliary devices in different positions on the weapon and desire to have the activation switch in unique positions based on individual shooting style. This results in no one cable length being optimal in all or even most situations.

This situation can be further complicated with multiple auxiliary devices being mounted on a single weapon at one time. As the quantity of auxiliary devices on a weapon increases, the number of cable switches multiplies causing increased cable management problems and adding appreciable weight, reliability issues, and snag hazards.

SUMMARY

In one aspect, a wireless control system includes an auxiliary device configured to be mounted on a weapon and a remote control device that wirelessly controls the auxiliary device. In another aspect, the wireless control system includes the weapon. In yet another aspect, the auxiliary device includes a light generating device. The light generating device includes an enclosure, a power source, a light source, a receiver, and a device function controller. The enclosure is configured to be mounted on a weapon. The receiver is in electrical communication with the power source, and the receiver is configured to receive a first wireless signal. The device function controller is in electrical communication with the power source, the receiver, and the light source. The device function controller is configured to control the light source based on the first wireless signal.

Other embodiments including any of the aspects above may also include one or more of the following features:

The wireless control system can include a receiver and a transmitter. The receiver and transmitter communicate with each other using radio frequency, infrared waves, a sound wave, a pressure wave, or other wireless techniques. The receiver may also be sensitive to a unique wavelength, pulse pattern, or signal strength. The auxiliary device and/or the remote control device can include an encoder configured to encode the first wireless signal. The auxiliary device and/or the remote control device can include a decoder configured to decode the first wireless signal. There can also be a second wireless signal, for example, transmitted by a transmitter. The second wireless signal can include status information of the remote control device and/or the auxiliary device.

The remote control device can be matched to the auxiliary device. A first key module is associated with the auxiliary device and a second key module is associated with the remote control device and communicates with the first key module. In certain embodiments, the first key module is a key generation module and the second key module is a key decoder module or vice versa. In other embodiments, the first key module is a key decoder module and the second key module is a key generation module or vice versa. The auxiliary device and/or the remote control device can include a key receiver and a key module, where the key receiver and the key module are cooperating to authenticate wireless signals received from an authorized source. The auxiliary device can include a receiver module to enable the remote control device to control the auxiliary device The remote control device includes a switch configured to control a function of the auxiliary device. Examples of the function include a state of the device (e.g., on/off), brightness level of light, level of sound, or level of power consumption. The remote control device switch can be configured to control a second function of the auxiliary device. The remote control device may be integral, permanently attached, or removably affixed to the weapon. The switch may also control a function of another auxiliary device. The remote control device may include more than one switch and include at least one of the following: a device selection switch, an activation switch, and a control switch. The switch can be a rotary or linear switch, a button, or a joystick.

The wireless control system may also include a display. The display may be configured to display a menu to select the weapon mounted auxiliary device or set a mode of operation. The display can be included on the remote control device The auxiliary device and/or the remote control device can include an indicator configured to indicate a status of a power source associated with a transmitter device transmitting a wireless signal to the remote control device and/or the auxiliary device (e.g. light generating device). The wireless signal can include a portion indicating a status of a power source associated with a transmitter device transmitting the wireless signal to/from the auxiliary device (e.g., the light generating device).

In another example, a second transmitter is associated with the auxiliary device, and a second receiver is associated with remote control device. In this example, the auxiliary device can transmit information to the remote control device. The information can include status information and commands. The information may include ready status, operational status, existing operational modes, target, range, azimuth, elevation data, self-diagnostics results, or battery life. The second receiver and second transmitter can communicate with each other using radio frequency, infrared waves, a sound wave, a pressure wave, or other wireless techniques.

In another example, the wireless control system includes a cable that is removably coupled to the remote control device or the auxiliary device. The transmitter can be disabled when the cable is engaged, for example, when the cable is coupled to both the remote control device and the auxiliary device. In another example, the wireless control system includes a mode of operation to limit detection. In order to limit detection, low RF power, spread spectrum technology, frequency hopping signals, or burst transmissions are used. The auxiliary device and/or the remote control device can include a watertight enclosure, which in some examples is watertight at depths greater than 50 feet.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
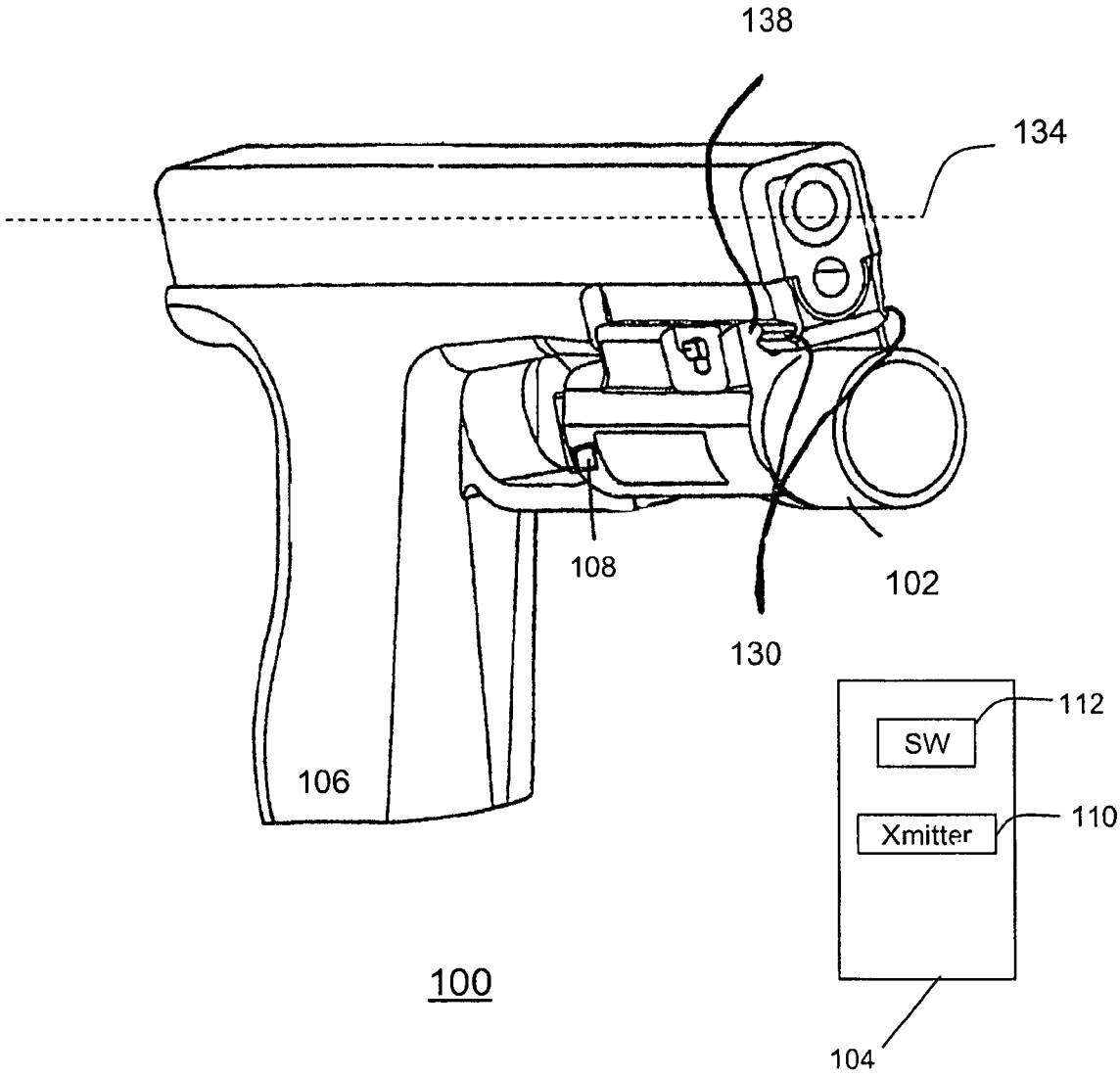
FIG. 1 is a first weapon having a wireless control system.

FIG. 1 illustrates a wireless control system 100 for wireless control of an auxiliary device, for example an illuminator 102, mounted on a weapon 106. Wireless control system 100 includes illuminator 102 and remote control device 104. Illuminator 102 is shown mounted on a weapon 106 and includes a receiver 108, which in operation receives signals wirelessly from remote control device 104. Remote control device 104 includes a transmitter 110 and a switch 112. Switch 112 can be, for example, any device capable of making or breaking an electric contact. For example, by depressing switch 112, an operator turns transmitter 110 on and off, thereby controlling illuminator 102.

Figure 4:
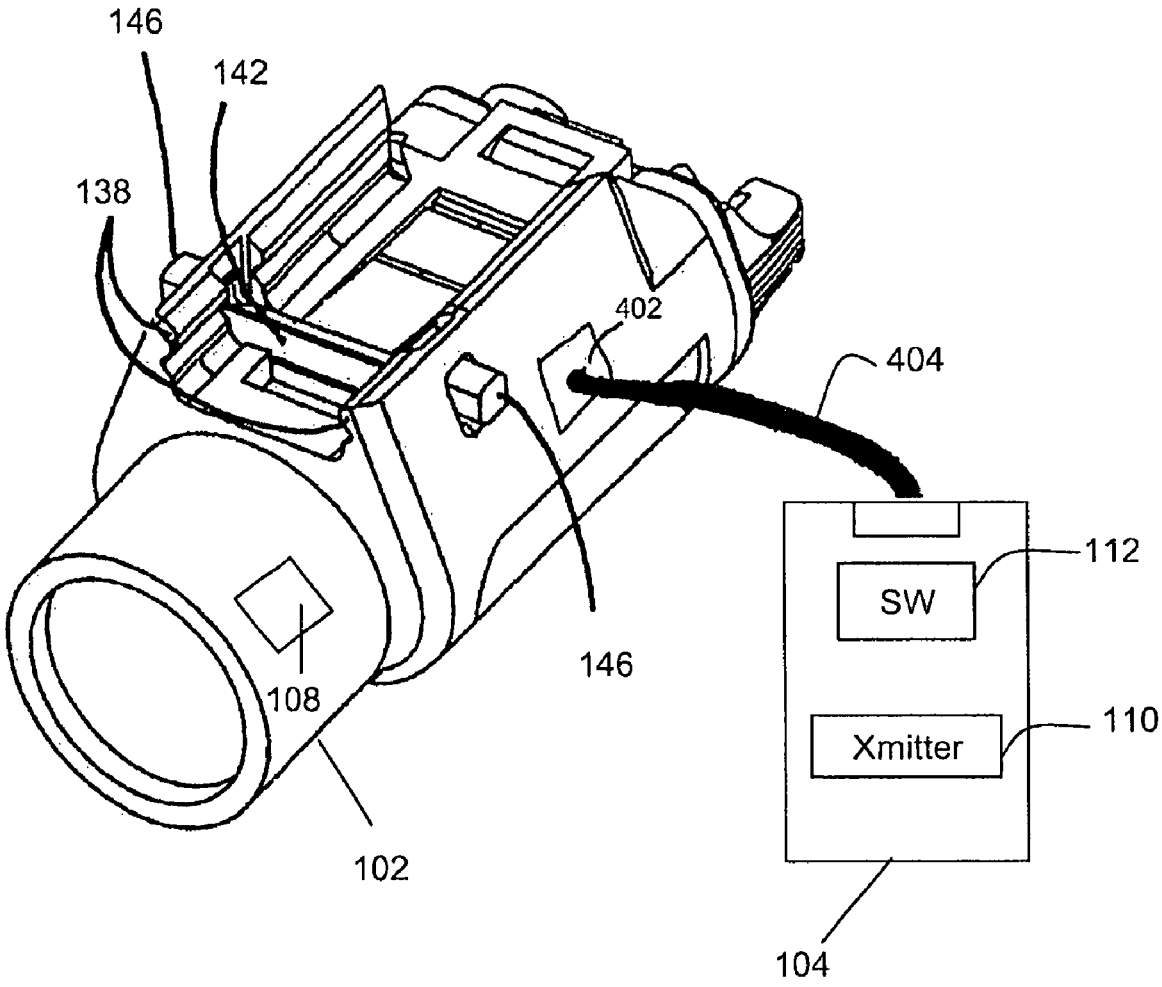
FIG. 4 shows an auxiliary device having a wireless control system including a wired mode.

The weapon 106 comprises a weapon frame with rails or grooves 130, located in and extending along at least a portion of the weapon frame, preferably parallel with an axis 134 of the barrel of weapon 106. The weapon frame also includes a slot (or other recess), for example, an elongated transverse slot (not shown), aligned substantially perpendicular to the rails 130. The slot is located between a trigger guard and the forward most portion of the frame. The illuminator 102, as shown in FIGS. 1 and 4, also comprises a housing and structural members extending therefrom, e.g., rigid elongated projections 138, extending along at least a portion of the illuminator 102. In one example, the rigid elongated projections 138 comprise tongues configured to be compatible with grooves 130 of weapon 106. For example, the longitudinal tongues of projections 138 may be spaced and sized such that they fit snugly within the grooves 130, but are capable of being slid therealong. Together, the rails 130 and projections 138 cooperate to function as a first positioning mechanism.

The illuminator 102 also includes a projection, e.g., spring-loaded elongated bar 142 (FIG. 4). The spring-loaded bar 142 is illustrated as being oriented substantially orthogonal to the longitudinal tongues of projections 138, but other orientations are possible. Preferably, spring-loaded bar 142 has a geometry that is complimentary to elongated transverse slot described above. Spring-loaded bar 142 has one or more ends 146 protruding through an opening formed in a portion of illuminator 102 (e.g., an upright extension projecting from the housing). A spring or other biasing mechanism preferably biases bar 142 upwardly. In operation, when the illuminator 102 is being slid relative to the weapon 106, a portion of the weapon 106 may overcome the bias force of the spring, until the illuminator 102 is at a predetermined position with respect to the weapon, for example when the spring-loaded bar 142 is positioned in alignment with the slot, whereupon, the spring causes the bar 142 to project into slot to fix the illuminator 102 in the predetermined position relative to the weapon 106. The engagement of bar 142 and the slot forms a second positioning mechanism and secures illuminator 102 onto weapon 106 to prevent inadvertent removal or misalignment of illuminator 102 due to external influences such as recoil. The first and second positioning mechanisms, and other alternatives, are described in more detail in U.S. Pat. No. 6,574,901, titled "Auxiliary Device for a Weapon and Attachment Thereof," issued on Feb. 13, 2001, and incorporated herein by reference.

Figure 2:
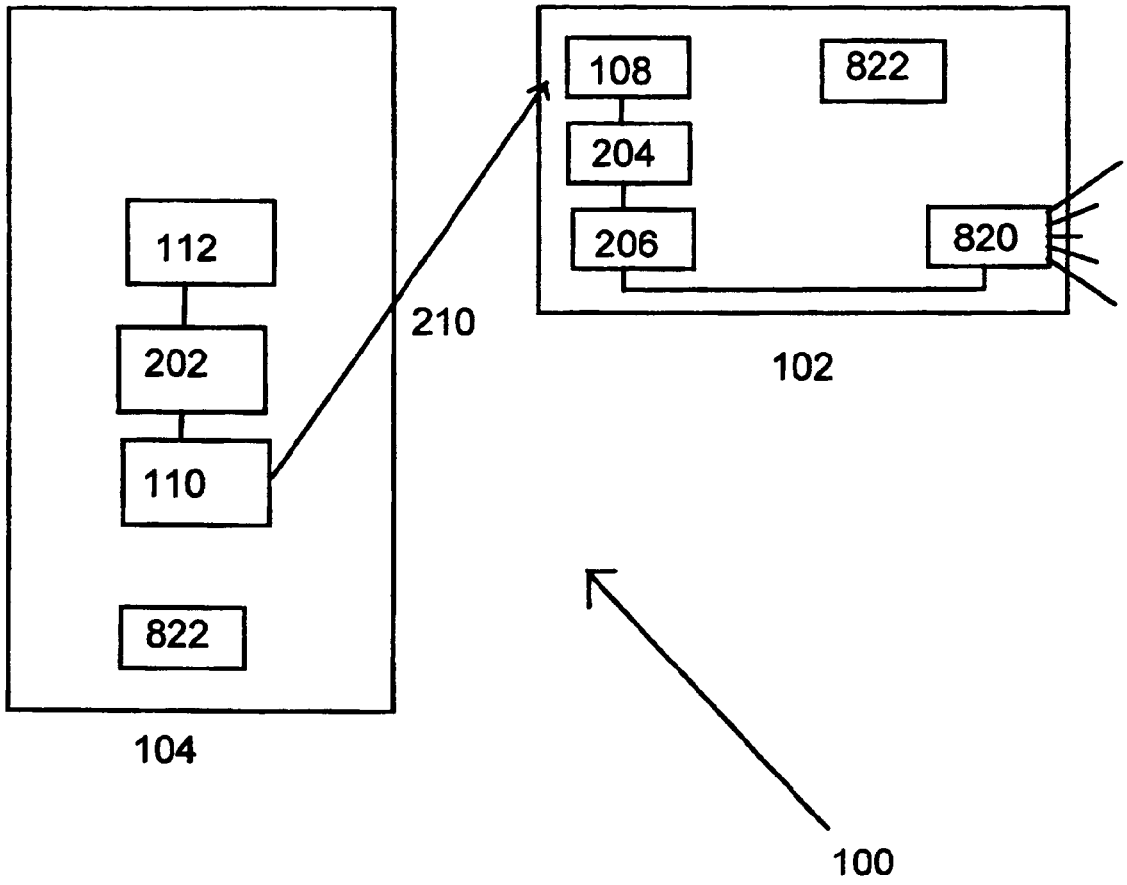
FIG. 2 is a block diagram of a remote control device and an auxiliary device of the wireless control system.

FIG. 2 illustrates system 100 depicting illuminator 102 and remote control device 104 in more detail. In addition to switch 112 and transmitter 110, remote control device 104 includes an encoder 202 and a power source 822. As illustrated, in addition to receiver 108, illuminator 102 also includes a decoder 204, a device function controller 206, a power source 822, and a light source 820. Further, the illuminator 102 may have a manual switch to control the illuminator without the remote control device 104. When an operator presses or actuates switch 112, encoder 202 encodes the signal and sends the encoded signal to transmitter 110, for example a radio frequency (RF) transmitter (e.g., 10 MHz-1 GHz). Remote control device 104 communicates with illuminator 102 by sending signals 210 from transmitter 110 to receiver 108. Receiver 108 receives signal 210 and sends the signal to decoder 204, which decodes the signal. Decoder 204 sends a decoded signal to device function controller 206 allowing wireless control of illuminator 102. For example, device function controller 206 can be a relay causing light source 820 to turn off and on depending on the state of the relay. While system 100 may use an RF signal for wireless communication, infrared waves, sound waves, pressure waves, and the like can also be used to transmit a signal. Due to the possibility of adverse environmental conditions in which system 100 may be used, the remote control device and the illuminator 102 may be housed in a watertight enclosure.

In one example, communication between remote control device 104 and the illuminator 102 is sufficiently unique so that signals from unintended remote control devices 104 do not affect other unintended auxiliary devices on an individual operator's weapon or a nearby operator's weapon. For example, if two soldiers are near each other, the first soldier does not want his illuminator 102 to activate in response to a signal from the second soldier's remote control device 104. In some examples, the techniques described herein to make an auxiliary device unique to a remote control device 104 can be used for a system with a master remote control device that individually controls a plurality of auxiliary devices.

The uniqueness between remote control device 104 and illuminator 102 can be accomplished in several ways. One such way is to provide a matched set including a remote control device 104 and an illuminator 102. For example, a manufacturer can produce a remote control device 104 and an illuminator device 102 as a matched set to operate at a unique frequency or with a unique device code that prefaces the code directing a particular operation of illuminator 102.

Figure 3:
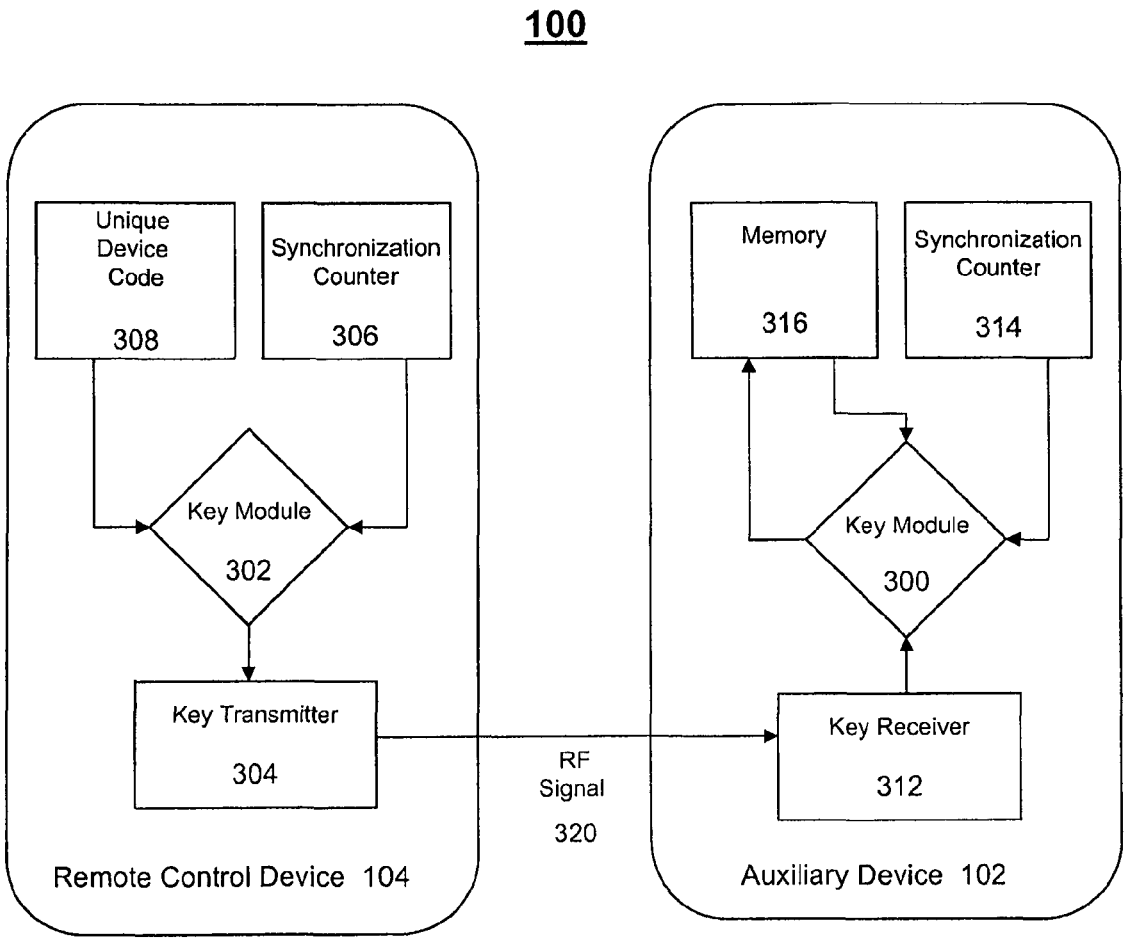
FIG. 3 is a block diagram of a remote control device and an auxiliary device including key modules.

FIG. 3 illustrates another way to obtain uniqueness between the remote control device 104 and illuminator 102. Remote control device 104 includes a key module 302, a key transmitter 304, a synchronization counter 306, and a unique device code 308. Similarly, illuminator 102 includes a key module 310, a key receiver 312, a synchronization counter 314, and a memory 316. In this example, key module 302 is a key generation module and key module 310 is a key decoding module. Upon entering a keying mode, a key transmitter 304 in remote control device 104 transmits a signal 320 to establish the unique frequency or unique device code 308 with illuminator 102. Illuminator 102 receives the key and key module 310 decodes the key. Illuminator 102 stores the decoded device code in memory 316. After the initial keying, remote control device 104 transmits the code for the auxiliary device and a key from the synchronization counter 306 on the next transmission. In this fashion, the keying code is different for each use because after each use synchronization counter 306 and synchronization counter 314 each update the key. In this example, illuminator 102 only responds to a signal with the correct key. While in this example, key module 302 in remote control device 104 is a key generation module and key module 310 in illuminator 102 is a key decoding module, the modules can be switched such that key module 302 is a key decoding module and key module 310 is a key generating module. Such an implementation can be advantageous for example, when illuminator 102 transmits signals to remote control device 104, as described in more detail below.

Keying allows an operator to match illuminator 102 to remote control device 104. In a case where remote control device 104 has not been used with illuminator 102, remote control device 104 initially transmits a unique code to illuminator 102. For example, the code may consist of the binary pattern 11001. Illuminator 102 receives this unique code (11001) and stores the code in memory 316. Illuminator 102 responds to a signal if the signal includes this unique code. Remote control device 104 also sends a number from synchronization counter 306. For example, synchronization counter 306 sends the number 284 to illuminator 102 and updates synchronization counter 306 to 285 (i.e., increments by one). Illuminator 102 stores the received number (284) in memory 316 and updates the synchronization counter to 285. On subsequent transmissions, remote control device 104 sends a signal to illuminator 102 that includes the unique code (11001) and the updated synchronization count (285). Key-module 310 in illuminator 102 confirms the unique code and the correct synchronization count. Upon confirmation of the correct code and count, illuminator 102 responds to control signal 320 from remote control device 104. Although this example follows a simple algorithm of incrementing the counters 306 and 314 by one, more sophisticated algorithms can be used.

Using a unique keying and rolling encryption algorithm eliminates unwanted activation of illuminator 102 by a different or other operator's remote control device 104. Also, by incorporating a provision for keying unique frequency or unique pulse, a particular remote control device 104 can be used to control different devices at different times. This is advantageous because new auxiliary devices can be issued to an operator without concern for the unique remote control device 104 the operator may have, and if a remote control device 104 is lost or becomes unserviceable, a replacement can be issued with out concern for the specific auxiliary devices the operator possesses. The operator only needs to key the illuminator 102 with the remote control device 104.

FIG. 4 illustrates a wired communication mode of operation including a remote control device 104 with a control switch 112 and transmitter 110, and an illuminator 102, including receiver 108 and a port 402. Some situations do not allow the use of wireless communication, for example in combat when an enemy might detect wireless transmissions, thus, compromising the location of the operator. For such instances where an operator desires wired communication, illuminator 102 includes communication port 402. A cable 404 connects illuminator 102 and remote control device 104. When communication port 402 is engaged (i.e. cable 404 is inserted) system 100 disables wireless transmitter 110 and illuminator 102 receives control signals through cable 404. When a user desires wireless control of illuminator 102, cable 404 can be removed.

Figure 5:
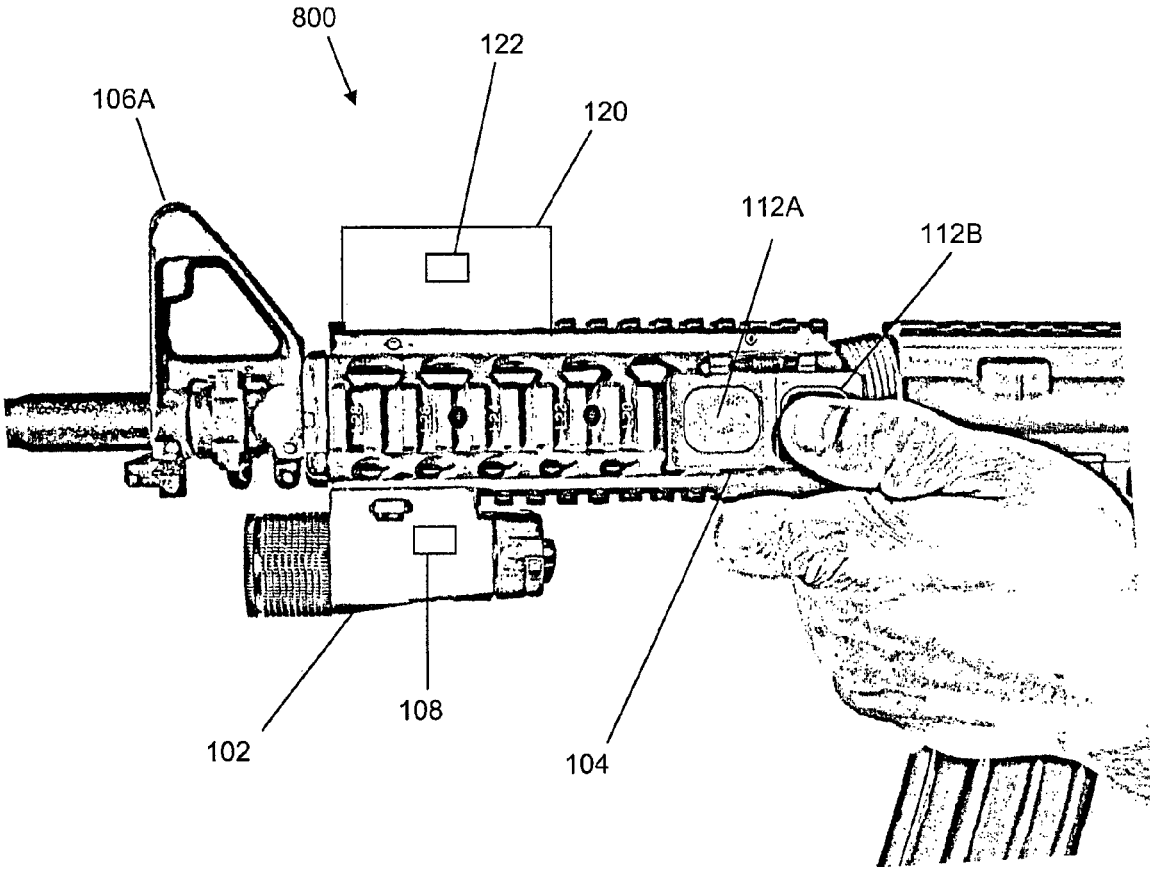
FIG. 5 is a second weapon having a wireless control system.

FIG. 5 illustrates a control system 800 for remote control of an illuminator 102 and an auxiliary device 120, for example a laser, mounted on a weapon 106A. The control system 800 may include a remote control device 104, the illuminator 102, and the auxiliary device 120. In one embodiment, the remote control device 104 communicates to the illuminator 102 and the auxiliary device 120 without a cable and in another embodiment the remote control device 104 communicates to the illuminator 102 and the auxiliary device 120 with a cable (not shown). The illuminator 102 may be mounted on the weapon 106A and includes a receiver 108, which in operation receives signals wirelessly from remote control device 104 allowing control of illuminator 102 by the remote control device 104. Remote control device 104 includes a transmitter 110, a first switch 112A, and a second switch 112B. For example, by depressing switch 112A, an operator may cause the transmitter 110 to send a signal 210A (see FIG. 8) to the receiver 108 in the illuminator 102, causing light source 820 to turn on or off. By depressing switch 112B, the operator may cause the transmitter 110 to send a signal 210B to the receiver 122 in the auxiliary device 120 to controllable device 824. Controllable device 824 may be a visible laser aiming devices, infrared laser aiming devices, infrared illuminators, laser range finders, visible illuminators, range finder or camera, for example a CCD or a thermal imager. One or more auxiliary devices, for example a visible illuminator and a visible laser aiming device, may be housed in a common enclosure. The illuminator 102, auxiliary device 120, and the remote control device 104 may each be powered by a power source 822, for example a battery. The operator can secure the remote control device 104 to the weapon in a convenient location with mechanical fasteners, for example hook and loop type fasteners, adhesive, or both.

A continuous actuation of switch 112A may cause transmitter 110 to transmit a signal 210A to the receiver 108 in the illuminator 102 causing the light source 820 to turn on and stay on as long as the switch 112A is actuated and release of the switch 112A may cause the light source 820 to turn off. In one embodiment, the transmitter 110 transmits continuously while the switch is actuated and in another embodiment, the transmitter 110 transmits a first signal when the switch is actuated and a second signal when the switch is released. The first signal and the second signal may be the same. A controller in the illuminator 102 may latch the light source on when it receives the first signal and unlatch the light source when it receive the second signal. Likewise, a continuous actuation of switches 112B may cause transmitter 110 to transmit a signal 210B to the receiver 122 in the auxiliary device 120 causing it to respond appropriately. For example, if auxiliary device 120 is a laser, continuous actuation of switch 112B can cause the laser to turn on and stay on as long as the switch 112B is actuated and release of the switch 112B may cause the laser to turn off. Alternatively, a single actuation of switch 112A may cause the light source 820 to latch on and a subsequent actuation of switch 112A may cause the light source 820 to turn off. Likewise, a single actuation of switch 112B may cause device 824 to latch on and a subsequent actuation of switch 112A may cause device 824 to turn off.

Alternatively, one or more actuations of switch 112A or 112B within a defined time period, for example two actuations within 50 msec, may cause the light source 820 or device 824 to latch on and a subsequent actuation of switch 112A or 112B may cause the light source 820 or device 824 to turn off.

Figure 6:
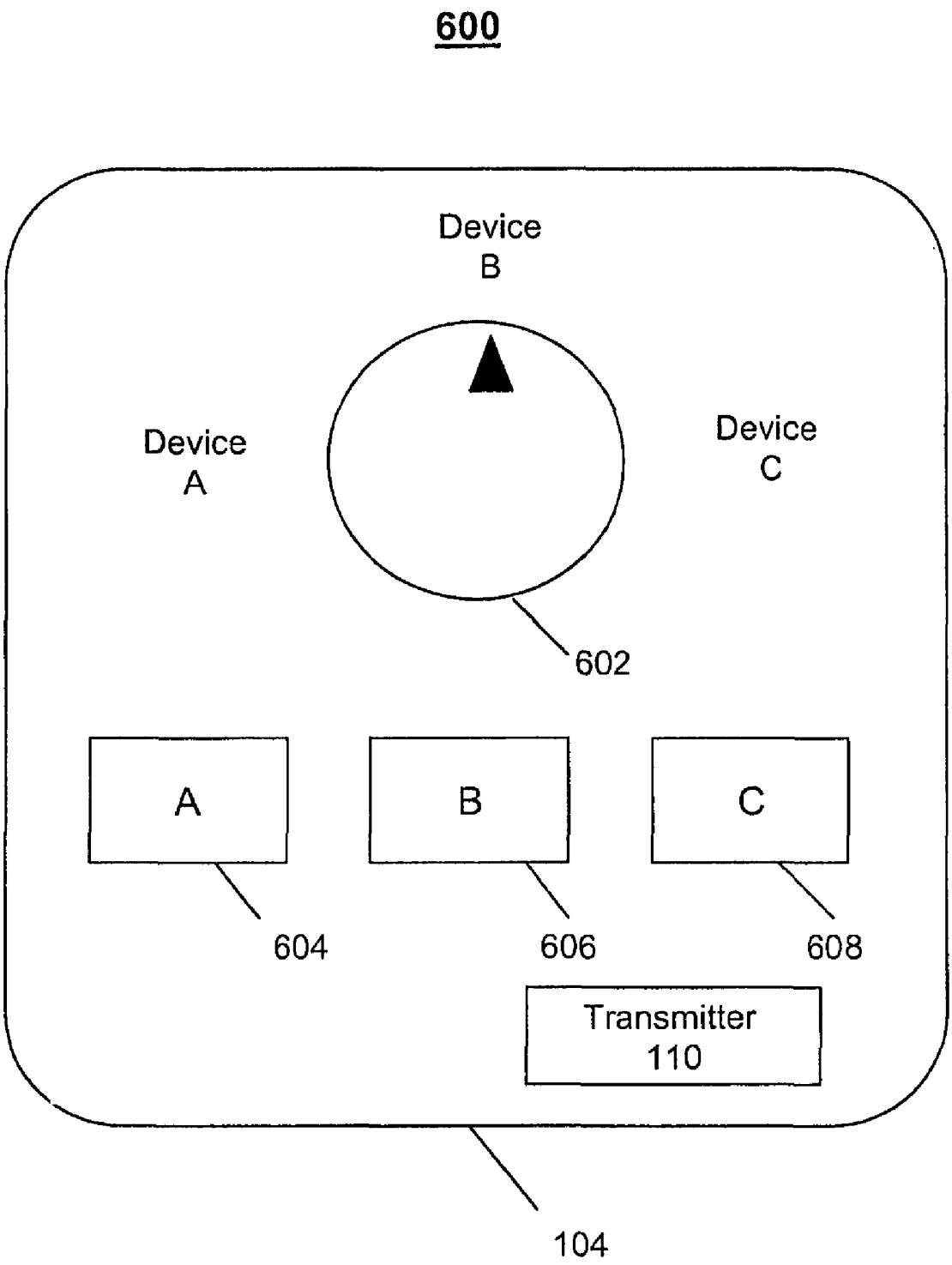
FIG. 6 is a schematic representation of a remote control device.
Figure 7:
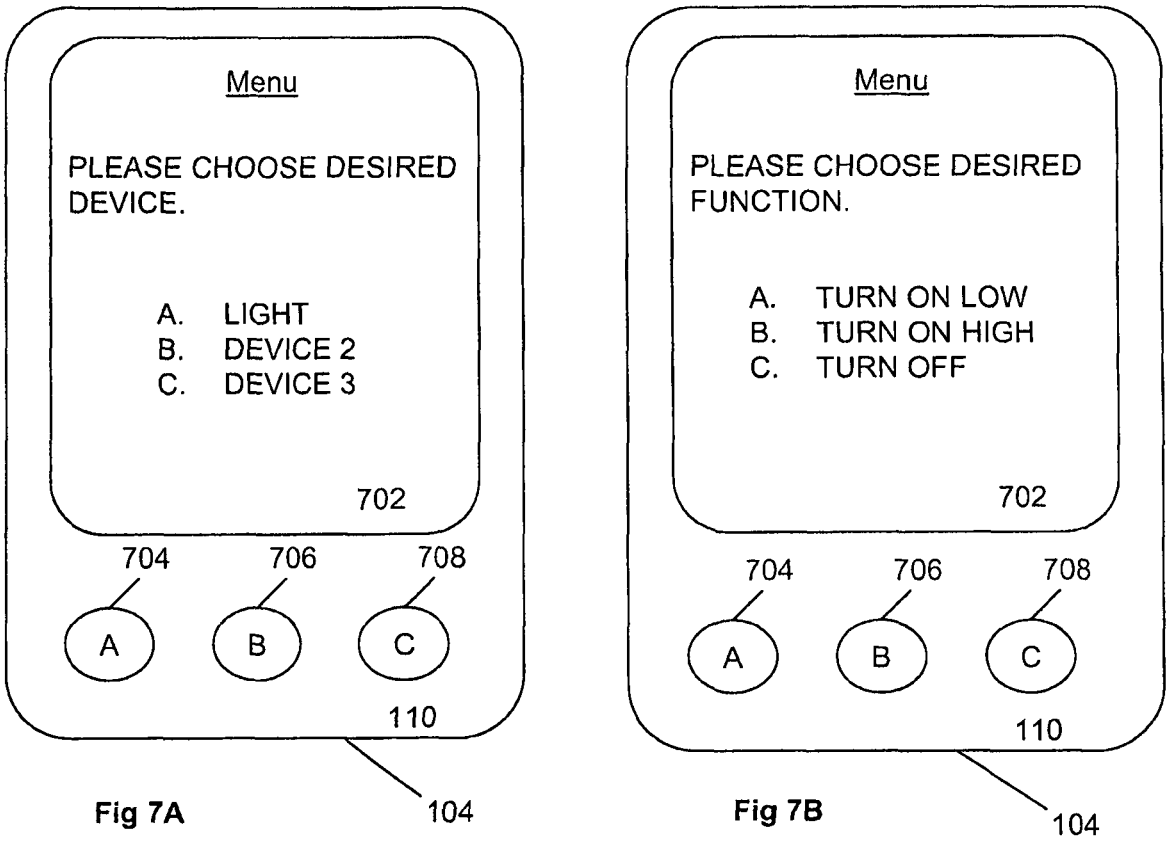
FIGS. 7A and 7B are schematic illustrations of other examples of remote control devices.

FIGS. 6, 7A, and 7B illustrate examples where multiple switches on remote control device 104 control multiple functions of illuminator 102, as well as multiple functions of multiple other auxiliary devices. In the case of controlling multiple functions of a particular illuminator 102, illuminator 102 has a receiver 108 capable of detecting and differentiating signals having, for example, different wavelengths, different pulse codes, or other uniquely coded signals. While in FIGS. 1-4, remote control device 104 includes a single switch 112 and transmitter 110, remote control device 104 may include more than one switch 112, as shown in FIGS. 5, 6 and 7. In such a case, activation of each switch results in transmission of a unique signal. The signals can be unique in terms of wavelength, pulse pattern or other means of signal coding.

In the case of a remote control device 104 controlling multiple auxiliary devices, the auxiliary devices are equipped with receivers 108 receptive to unique wavelengths, unique pulse patterns, or other unique signal coding. In such case, activation of a particular switch on the remote control unit results in activation of a unique auxiliary device.

For example, as illustrated in FIG. 6 remote control device 104 includes a rotary switch 602. A user selects a particular auxiliary device using a rotary switch 602. In this example, the user has selected "B" as indicated by the position of rotary switch 602. Remote control device 104 also includes switches 604, 606, and 608. These switches control the particular functions of the selected auxiliary device. These functions may include for example the state of the device, brightness of light, level of sound, and level of power consumption.

For an illustrative example, device "B" is an auxiliary light with three levels: off; low; and high. The user selects the particular auxiliary light by turning rotary switch 602 to position B. Each button 604, 606, and 608 controls a level of the selected device. Button 604 turns the light off, button 606 turns the light on low, and button 608 turns the light on high. If the user wants to turn the light on low, the user sets rotary switch 602 to position B and presses button 604. These actions cause only auxiliary device "B" to turn on to a low level.

In another example, as shown in FIGS. 7A and 7B, remote control 104 includes a menu based selection system that appears on a display 702 and responds to user input. In FIG. 7A, the user selects a desired auxiliary device by pressing button 704, 706, or 708. For example, if the user desires to control a light-generating unit, the user selects choice A by pressing button 704. A second menu, as shown in FIG. 7B, allows the user to select the desired operation of the auxiliary device. For example, if the user desires to turn the light on low, the user selects choice A by pressing button 704.

The examples above show switch 112 to be either a button or a rotary switch, but switch 112 can also be a joystick type control switch used to select and then scroll through a series of menus on a display to enable the operator to preset controls and performance parameters as well as a device or devices to be activated. Pressing one of a limited number of buttons on the remote control device activates each particular auxiliary device in a prescribed fashion, or pressing a single button can cause a series of events to occur by one or a multitude of auxiliary devices. Alternatively, the display 702 may be touch sensitive and allow the operator to make selections directly on the display.

Figure 8:
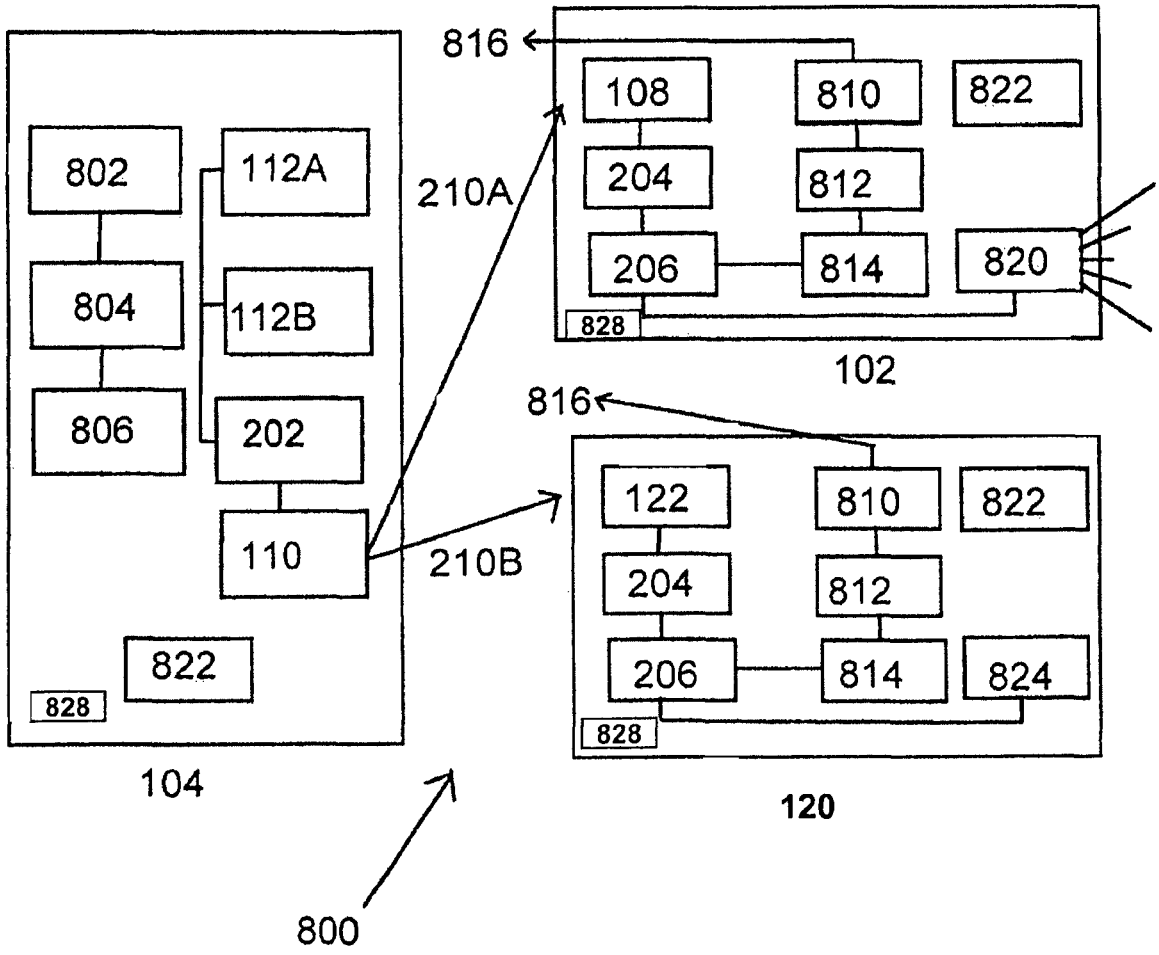
FIG. 8 is a block diagram of a wireless control system having a remote control device and one or more auxiliary devices.

In the preceding examples, the remote control device 104 transmits a signal 210 to the illuminator 102 to control the operation of illuminator 102. FIG. 8 illustrates a two-way communication wireless control system 800 including a remote control device 104, an illuminator 102, and an auxiliary device 120 that may be mounted to a weapon. The remote control device 104 transmits and receives signals or information to the illuminator 102 and the auxiliary device 120. Illuminator 102 includes both a receiver 108 and a transmitter 810, auxiliary device 120 includes both a receiver 122 and a transmitter 810, and remote control device 104 includes a transmitter 110 and a receiver 802. Alternatively, the receiver and transmitter of any of the devices (e.g., illuminator 102, remote control device 104, and/or auxiliary device 120) may be combined into a transceiver or a microcontroller, for example a model CC1010 microcontroller from Chipcon of Norway. Illuminator 102 may also include a decoder 204, a device function controller 206, a device status module 814, an encoder 812, a power source 822, for example a battery, an indicator 828 (e.g., a light emitting diode (LED) or an audible sound generator), and a light source 820 capable of generating visible or invisible light. An LED may be capable of communicating a visual signal to an operator in one or more colors. Auxiliary device 120 may also include a decoder 204, a device function controller 206, a device status module 814, an encoder 812, a power source 822, an indicator 828, and a controllable device 824. Remote control device 104 may also include a first switch 112A, a second switch 112B, an encoder 202, a decoder 804, a status display 806, and a power source 822.

Remote control device 104, illuminator 102, and auxiliary device 120 may utilize key modules in order to assign a switch on the remote control device 104 to the illuminator 102 or the auxiliary device 120. For example, illuminator 102 may be assigned to respond to switch 112A and auxiliary device 120 may be assigned to respond to switch 112B, or vice versa.

The signal 210 may include a family or customer identifier, a serial number, and one or more commands. The family or customer identifier and the serial number may be hard coded at the factory. The family or customer identifier allows illuminators and auxiliary devices to only respond to a particular family or customer remote control. The signal 210 may utilize rolling codes and encryption to prevent unauthorized control of illuminators and auxiliary devices. Communication between the remote control device 104, the illuminator 102, and the auxiliary device 120 may utilize a lower bandwidth to transmit ready status, operational status, and operational mode and utilize a higher bandwidth to transmit range, azimuth, and elevational data, self-diagnostic results, and video. The data, including the video, may be transmitted to an eyepiece that is part of a day optics and/or night vision optics.

Receiver 802 in remote control device 104 receives information 816 from illuminator 102 and auxiliary device 120. Such information may include, for example, ready status, operational status, existing operational modes, target range-azimuth-elevation data, results of self-diagnostics, remaining battery life or other information that is beneficial for an operator to have at the remote control device. Such information can also advise remote control device 104 of a particular situation or condition such that remote control device 104 can direct illuminator 102 to operate in a particular mode.

For example, illuminator 102 can be a battery-operated light. An operator activates the light by pressing the switch 112A on remote control device 104. When the operator presses switch 112A, encoder 202 encodes the signal and transmitter 110 sends a signal 210A to illuminator 102. Receiver 108 receives signal 210A, decoder 204 decodes the signal 210A, and the device function controller 206 turns on the light source 820. After using the light for an extended period, the battery may begin to run low. At this point, using device status module 814, illuminator 102 senses the low battery and encodes a signal using encoder 812. Transmitter 810 sends a signal 816 to receiver 802. Decoder 804 decodes signal 816 and displays the status on the status display 806 of the remote control device 104. This feedback allows the user to know the battery is low and adjust the usage of illuminator 102 accordingly. Data from the illuminator 102 and the auxiliary device 120 may be displayed in the status display 806 in the remote control device 104 or an eyepiece that is part of a day optics and/or night vision optics.

When the output voltage of the power source 822 in the remote control device 104 drops below a predetermined value, the transmitter 110 can send a "low battery" signal to the illuminator 102 and/or the auxiliary device 120. The "low battery" condition may be sensed by a suitable circuit. The "low battery" signal can be communicated, visually or audibly, to the operator through the indicator 828. The indicator 828 may be caused to stay on continuously, blink, or change color, or make an audible tone to communicate the "low battery" condition to the operator. Alternatively, the "low battery" condition can be communicated to the operator through indicator 828 on the remote control device 104. The indicator 828 advantageously enables the wireless control system 800 to notify the operator that due to a low power source, the wireless system 800 may not be or may become less than fully functional (e.g., actuating a button on the remote device 104 may no longer cause a change to the state of the auxiliary device 120). This allows the operator to recharge/replace the power source 822 or to switch to manual (e.g., non-wireless) portions of the system 800 to perform the desired operations.

In one embodiment, the auxiliary device is a remotely controllable camera. The camera may be mounted on a weapon to allow the operator to survey an area without placing his head in harms way. A remote control device allows the camera to pan, tilt, and zoom. Data from the auxiliary device may be transmitted to a display on the remote control device or an eyepiece that is part of a day optics and/or night vision optics.

Remote control device 104 can communicate with a global positioning system (GPS) mounted on an operator/soldier. Remote control device 104 can be wired or wireless to the GPS and can be mounted on the operator or on the weapon. The operator can point the laser on a target and transmit distance and angular position (as determined from a compass) from operator's position to assist in determining target's global position. The information can be displayed in day optics and/or night vision optics. Likewise, the GPS unit can communicate target angular position to the operator for ease in target acquisition.

In other examples, it may be desired that personnel, other than the operator, not detect the wireless signal or other communication between the remote control device 104 and the auxiliary device. For this reason, system 100 includes the capability to operate at low RF power levels, use spread spectrum technology, use frequency hopping signals, or use burst transmissions, all of which may reduce the possibility of unwanted detection.

While the preceding examples have shown remote control device 104 to be separate from weapon 106 to which illuminator 102 is attached, the remote control device 104 can be integrated, for example, directly into the rear pistol grip, forward pistol grip, trigger grip and/or upper receiver and lower receiver of the weapon. Remote control device 104 can essentially be integrated into any area that is convenient for the operator to access switch 112 to remotely control illuminator 102. Weapons 106 can include both lightweight pistols, rifles, and machine guns, heavier portable weapons, and fixed installation weapons.

While FIGS. 1-8 are described using an illuminator 102, the wireless control system can be used with other auxiliary devices. For example, passive devices such as night vision image intensifier devices and thermal imaging systems, and active devices such as visible laser aiming devices, infrared laser aiming device, and infrared illuminators can be used.

Figure 9:
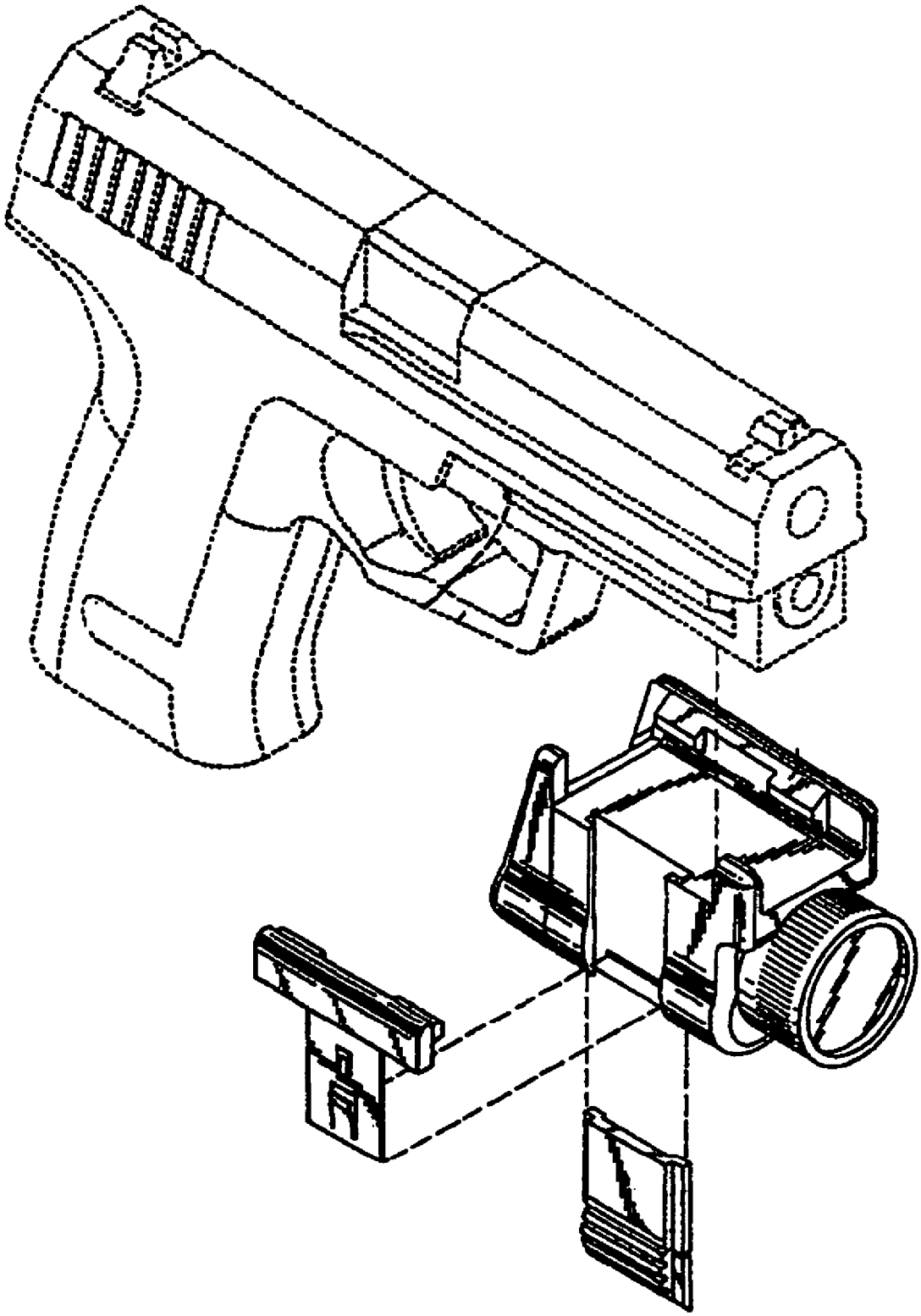
FIG. 9 shows an example mounting mechanism for an auxiliary device.
Figure 10:
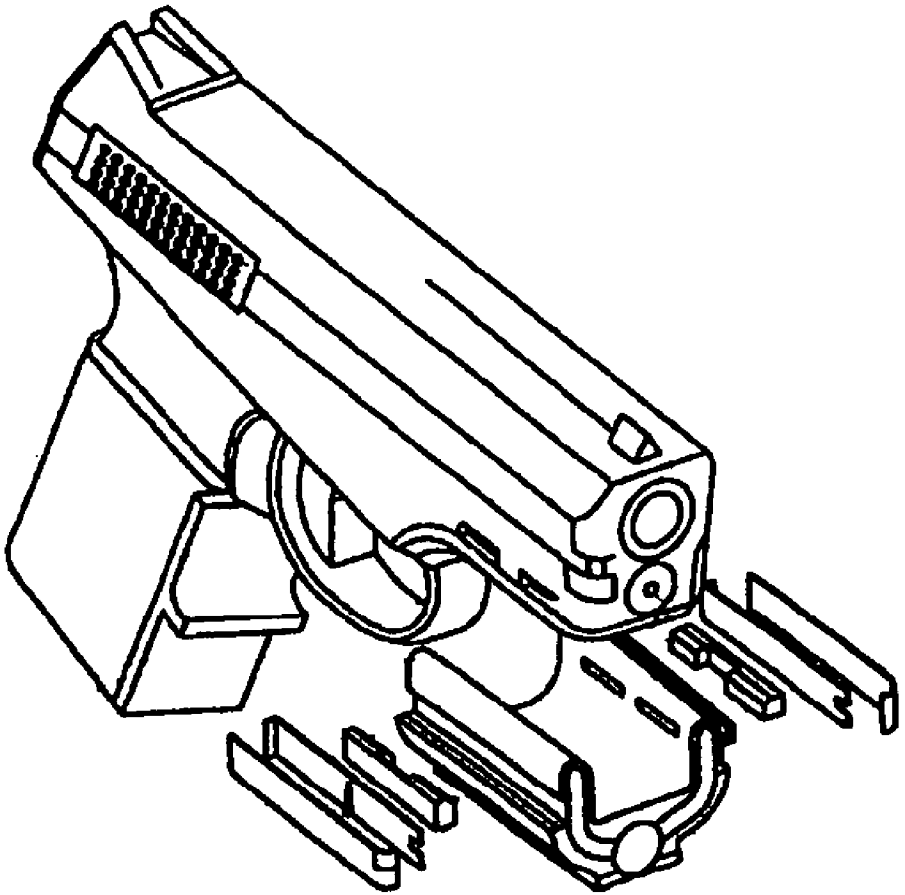
FIG. 10 shows another example mounting mechanism for an auxiliary device.

FIGS. 9 and 10 show some of the many alternative mounting mechanisms to mount an auxiliary device to a weapon. FIG. 9 shows a mechanism that clamps onto the rails of the weapon. This mechanism is described in more detail in U.S. Pat. No. 5,430,967, titled, Aiming Assistance Device for a Weapon, issued on Jul. 11, 1995, and is incorporated herein by reference. FIG. 10 shows a mechanism that inserts into slots of the weapon. This mechanism is described in more detail in U.S. Pat. No. 6,705,038, titled, Mounting Assembly for a Weapon, issued on Mar. 16, 2004, and is incorporated herein by reference. Additionally, the auxiliary device may utilize a mounting mechanism disclosed in military specification (e.g., MIL-STD-1913), a "rail grabber" mounting mechanism, screws, bolts, and/or the like.

A number of embodiments of the invention have been described. Nevertheless, it will be understood that various modifications may be made without departing from the spirit and scope of the invention. Accordingly, other embodiments are within the scope of the following claims.

What is claimed is:

1. A method of facilitating replacement of an auxiliary device associated with a weapon:

facilitating mounting the auxiliary device to the weapon at a first fixed distance from a remote control device configured to control the auxiliary device;

facilitating keying said remote control device to the auxiliary device to establish bi-directional wireless communication between said remote control device and the auxiliary device comprising:

initiating an exchange of a unique device code and a synchronization count between said remote control device and the auxiliary device, said unique device code being different from any key codes associated with other auxiliary devices mounted to other weapons to avoid control of one or more of said other auxiliary devices by said remote control device;

enabling an update of said synchronization count in said remote control device and said auxiliary device upon each transmission between said remote control device and the auxiliary device;

facilitating mounting a replacement auxiliary device to the weapon at a second fixed distance from said remote control device in place of the auxiliary device, said remote control device being configured to control said replacement auxiliary device; and facilitating keying said remote control device to said replacement auxiliary device to establish bi-directional wireless communication between said remote control device and said replacement auxiliary device comprising:

initiating exchange of a second unique device code different from said first unique device code and a second synchronization count between said remote control device and said replacement auxiliary device, said second unique device code being different from any key codes associated with said other auxiliary devices mounted to said other weapons to avoid control of one or more of said other auxiliary devices by said remote control device; and enabling an update of said second synchronization count in said remote control device and said replacement auxiliary device upon each transmission between said remote control and said replacement auxiliary device.

2. A method according to claim 1, wherein said first fixed distance is different from said second fixed distance.

3. A method according to claim 1, wherein said unique device code is stored in the auxiliary device.

4. A method according to claim 1, wherein said second unique device code is stored in said replacement auxiliary device.

5. A method according to claim 1, wherein said enabling exchange of said unique device code comprises causing transmission of said unique device code from said remote control device to the auxiliary device.

6. A method according to claim 1, wherein said enabling exchange of said second unique device code comprises causing transmission of said second unique device code from said remote control device to said replacement auxiliary device.

7. A method according to claim 1, wherein said enabling an update of said synchronization count comprises enabling an increase of said synchronization count by a value of one.

8. A method according to claim 1, wherein said enabling an update of said second synchronization count comprises enabling an increase of said second synchronization count by a value of one.

9. A method according to claim 1, wherein said unique device code and said second unique device code are established by a key module provided in said remote control device.

10. A method according to claim 1, wherein said unique device code is established by a key module provided in said auxiliary device and said second unique device code is established by a second key module in said replacement auxiliary device.

11. A method according to claim 1, wherein said bi-directional wireless communication is established using radio frequency signals.

12. A method of facilitating replacement of an auxiliary device associated with a weapon:

facilitating mounting the auxiliary device to the weapon at a first fixed distance from a remote control device configured to control the auxiliary device;

facilitating keying said remote control device to the auxiliary device to establish bi-directional wireless communication between said remote control device and the auxiliary device comprising:

initiating an exchange of a unique device code and a synchronization count between said remote control device and the auxiliary device, said unique device code being different from any key codes associated with other auxiliary devices mounted to other weapons to avoid control of one or more of said other auxiliary devices by said remote control device, said unique device code being stored in said auxiliary device or said remote control device;

enabling an update of said synchronization count in said remote control device and said auxiliary device upon each transmission between said remote control device and the auxiliary device;

facilitating mounting a replacement auxiliary device to the weapon at a second fixed distance from said remote control device in place of the auxiliary device, said remote control device being configured to control said replacement auxiliary device; and facilitating keying said remote control device to said replacement auxiliary device to establish bi-directional wireless communication between said remote control device and said replacement auxiliary device comprising:

initiating an exchange of a second unique device code different from said first unique device code and a second synchronization count between said remote control device and said replacement auxiliary device, said second unique device code being different from any key codes associated with said other auxiliary devices mounted to said other weapons to avoid control of one or more of said other auxiliary devices by said remote control device, said second unique device code being stored in said replacement auxiliary device or said remote control device;

enabling an update of said second synchronization count in said remote control device and said replacement auxiliary device upon each transmission between said remote control and said replacement auxiliary device.

13. A method according to claim 12, wherein said first fixed distance is different from said second fixed distance.

14. A method according to claim 12, wherein said enabling exchange of said unique device code comprises causing transmission of said unique device code from said remote control device to the auxiliary device.

15. A method according to claim 12, wherein said enabling exchange of said second unique device code comprises causing transmission of said second unique device code from said remote control device to said replacement auxiliary device.

16. A method according to claim 12, wherein said enabling an update of said synchronization count comprises enabling an increase of said synchronization count by a value of one.

17. A method according to claim 12, wherein said enabling an update of said second synchronization count comprises enabling an increase of said second synchronization count by a value of one.

18. A method according to claim 12, wherein said unique device code and said second unique device code are established by a key module provided in said remote control device.

19. A method according to claim 12, wherein said unique device code is established by a key module provided in said auxiliary device and said second unique device code is established by a second key module in said replacement auxiliary device.

20. A method according to claim 12, wherein said bi-directional wireless communication is established using radio frequency signals.

* * * * *